US007038122B2

(12) United States Patent
Nishitani et al.

(10) Patent No.: US 7,038,122 B2
(45) Date of Patent: May 2, 2006

(54) MUSICAL TONE GENERATION CONTROL SYSTEM, MUSICAL TONE GENERATION CONTROL METHOD, MUSICAL TONE GENERATION CONTROL APPARATUS, OPERATING TERMINAL, MUSICAL TONE GENERATION CONTROL PROGRAM AND STORAGE MEDIUM STORING MUSICAL TONE GENERATION CONTROL PROGRAM

(75) Inventors: Yoshiki Nishitani, Shizuoka-ken (JP); Satoshi Usa, Shizuoka-ken (JP); Eiko Kobayashi, Shizuoka-ken (JP); Akira Miki, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/141,651

(22) Filed: May 8, 2002

(65) Prior Publication Data

US 2002/0166438 A1 Nov. 14, 2002

(30) Foreign Application Priority Data

May 8, 2001 (JP) ..... 2001-137769

(51) Int. Cl.
*G10H 3/00* (2006.01)

(52) U.S. Cl. ..... 84/723; 84/735

(58) Field of Classification Search ..... 84/600, 84/723–724, 730, 735, 737
See application file for complete search history.

(56) References Cited

U.S. PATENT DOCUMENTS 5,027,688 A 7/1991 Suzuki et al.
5,046,394 A 9/1991 Suzuki et al.
5,058,480 A 10/1991 Suzuki et al.
5,177,311 A 1/1993 Suzuki et al.
5,290,964 A 3/1994 Hiyoshi et al.
5,313,010 A 5/1994 Matsushima et al.
5,512,703 A 4/1996 Usa
5,585,584 A 12/1996 Usa
5,648,627 A 7/1997 Usa
5,663,514 A 9/1997 Usa
2001/0015123 A1 8/2001 Nishitani et al.

FOREIGN PATENT DOCUMENTS

JP 09-127937 5/1997

*Primary Examiner*—Marlon Fletcher
(74) *Attorney, Agent, or Firm*—Harness, Dickey & Pierce, P.L.C.

(57) ABSTRACT

There is provided a musical tone generation control system which enables the user to obtain a feeling of operation as well as to obtain a feeling of satisfaction as if he or she were aggressively participating in performance or playback of a musical composition or the like. The musical tone generation control system has at least one operating terminal that can be carried by an operator. Each operating terminal detects a motion of the operating terminal caused by an operation of the operator, generates motion information based on the detected motion, and transmits the generated motion information to the musical tone generation control apparatus. A musical tone generation control apparatus including a tone generating apparatus that generates musical tones generates performance control information for controlling musical tones generated from the tone generating apparatus based on the received motion information, generates vibration control information based on the generated performance control information, and transmits the generated vibration control information to the operating terminal. The operating terminal generates a vibration corresponding to the received vibration control information.

22 Claims, 10 Drawing Sheets

MUSICAL TONE GENERATION CONTROL SYSTEM, MUSICAL TONE GENERATION CONTROL METHOD, MUSICAL TONE GENERATION CONTROL APPARATUS, OPERATING TERMINAL, MUSICAL TONE GENERATION CONTROL PROGRAM AND STORAGE MEDIUM STORING MUSICAL TONE GENERATION CONTROL PROGRAM

BACKGROUND OF THE INVENTION

1. Field of the Invention

The present invention relates to a musical tone generation control system, a musical tone generation control method, a musical tone generation control apparatus, and a musical tone generation control program using operating terminals that generate motion information used for controlling generation of musical tones, and a storage medium storing the musical tone generation control program.

2. Description of the Related Art

In a tone generating apparatus such as audio equipment, once four performance parameters such as tone color, pitch, volume and effects are determined, desired musical tones can be generated. In reproducing a musical composition recorded in a CD (Compact Disc) or the like by using such a tone generating apparatus, the user listens to the desired musical composition by adjusting parameters such as volume by manipulating operating knobs or the like of the tone generating apparatus.

Thus, in carrying out performance or playback of a musical composition by using the conventional tone generating apparatus, the user can do nothing but adjusting parameters such as volume by simply manipulating operating knobs, and therefore cannot obtain a feeling of operation. Moreover, the user cannot get a feeling of satisfaction as if he or she were directing performance or playback of a musical composition since he can merely adjust parameters such as volume through such manipulation. Thus, the conventional tone generating apparatus lacks amusingness.

SUMMARY OF THE INVENTION

It is an object of the present invention to provide a musical tone generation control system, a musical tone generation control method, a musical tone generation control apparatus, at least one operating terminal, a musical tone generation control program which enable the user to obtain a feeling of operation as well as to obtain a feeling of satisfaction as if he or she were aggressively participating in performance or playback of a musical composition or the like, and a storage medium storing the musical tone generation control program.

To attain the above object, in a first aspect of the present invention, there is provided a musical tone generation control system comprising at least one operating terminal that can be carried by an operator, and a musical tone generation control apparatus including a tone generating apparatus that generates musical tones, the operating terminal having a device that detects a motion of the operating terminal caused by an operation of the operator, generates motion information based on the detected motion, and transmits the generated motion information to the musical tone generation control apparatus, the musical tone generation control apparatus having a device that generates performance control information for controlling musical tones generated from the tone generating apparatus based on the received motion information , generates vibration control information based on the generated performance control information, and transmits the generated vibration control information to the operating terminal, and the operating terminal having a device that generates a vibration corresponding to the received vibration control information.

In the present specification, the term "performance control information" is defined as information for controlling at least one parameter selected from the group consisting of tempo, volume, pitch, tone generation timing, tone color, and one or more effects, and the term "vibration control information" is defined as information for controlling at least one parameter selected from the group consisting of vibration generation timing, vibration frequency, and intensity of vibration.

To attain the above object, in a second aspect of the present invention, there is provided a musical tone generation control system comprising at least one operating terminal that can be carried by an operator, at least one informing apparatus formed in a separate body from the operating terminal, and a musical tone generation control apparatus including a tone generating apparatus that generates musical tones, the operating terminal having a device that detects a motion of the operating terminal caused by an operation of the operator, generates motion information based on the detected motion, and transmits the generated motion information to the musical tone generation control apparatus, the musical tone generation control apparatus having a device that generates performance control information for controlling musical tones generated from the tone generating apparatus based on the received motion information generates vibration control information based on the generated performance control information, and transmits the generated vibration control information to the operating terminal, and the informing apparatus having a device that generates a vibration corresponding to the received vibration control information.

To attain the above object, in a third aspect of the present invention, there is provided a musical tone generation control system comprising at least one operating terminal that can be carried by an operator, and a storage device that stores musical composition data, a musical tone generation control apparatus including a tone generating apparatus that generates musical tones, the operating terminal having a device that detects a motion of the operating terminal caused by an operation of the operator, generates motion information based on the detected motion, and transmits the generated motion information to the musical tone generation control apparatus, the musical tone generation control apparatus having a device that generates performance control information for controlling musical tones generated from the tone generating apparatus based on the received motion information and the musical composition data stored in the storage device, generates vibration control information based on the generated performance control information, and transmits the generated vibration control information to the operating terminal, and the operating terminal having a device that generates a vibration corresponding to the received vibration control information.

To attain the above object, in a fourth aspect of the present invention, there is provided a musical tone generation control method comprising the steps of detecting a motion of at least one operating terminal that can be carried by an operator, caused by an operation of the operator, generating motion information based on the detected motion, and transmitting the generated motion information to a musical tone generation control apparatus including a tone generating apparatus that generates musical tones, generating performance control information for controlling musical tones generated from the tone generating apparatus based on the received motion information , generating vibration control information based on the generated performance control information, and transmitting the generated vibration control information to the operating terminal, and causing the operating terminal to generate a vibration corresponding to the received vibration control information.

To attain the above object, in a fifth aspect of the present invention, there is provided a musical tone generation control apparatus comprising a tone generating apparatus that generates musical tones, a device that receives motion information from at least one operating terminal that can be carried by an operator, the motion information being generated by the operating terminal by detecting a motion of the operating terminal caused by an operation of the operator, and a device that generates performance control information for controlling musical tones generated from the tone generating apparatus based on the received motion information, and generates vibration control information based on the generated performance control information, and transmits the generated vibration control information to the operating terminal.

To attain the above object, in a sixth aspect of the present invention, there is provided a musical tone generation control apparatus comprising a tone generating apparatus that generates musical tones, a device that receives motion information from at least one operating terminal that can be carried by an operator, the motion information being generated by the operating terminal by detecting a motion of the operating terminal caused by an operation of the operator, and a device that generates performance control information for controlling musical tones generated from the tone generating apparatus based on the received motion information, and generates vibration control information based on the generated performance control information, and transmits the generated vibration control information to at least one information apparatus formed in a separate body from the operating terminal.

To attain the above object, in a seventh aspect of the present invention, there is provided a musical tone generation control apparatus comprising a tone generating apparatus that generates musical tones, a device that receives motion information from at least one operating terminal that can be carried by an operator, the motion information being generated by the operating terminal by detecting a motion of the operating terminal caused by an operation of the operator, a storage device that stores musical composition data, and a device that generates performance control information for controlling musical tones generated from the tone generating apparatus based on the received motion information and the musical composition data, and generates vibration control information based on the generated performance control information, and transmits the generated vibration control information to the operating terminal, while outputting the generated performance control information to the tone generating apparatus.

To attain the above object, in an eighth aspect of the present invention, there is provided an operating terminal that can be carried by an operator, comprising a device that detects a motion of the operating terminal caused by an operation of the operator and generates motion information based on the detected motion, a device that generates performance control information for controlling musical tones generated from a tone generating apparatus, based on the generated motion information, and generates a vibration based on the generated performance control information, and a device that transmits the generated performance control information to the tone generating apparatus.

To attain the above object, in a ninth aspect of the present invention, there is provided a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, and a module for generating vibration control information for generating a vibration, based on the performance control information, and for instructing the communication apparatus to transmit the generated vibration control information to the operating terminal.

To attain the above object, in a tenth aspect of the present invention, there is provided a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, and a module for generating vibration control information for generating a vibration, based on the performance control information, and for instructing the communication apparatus to transmit the generated vibration control information to an information apparatus formed in a separate body from the operating terminal.

To attain the above object, in an eleventh aspect of the present invention, there is provided a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, a module for storing musical composition data, and a module for generating vibration control information for generating a vibration, based on the musical composition data, and for instructing the communication apparatus to transmit the generated vibration control information to the operating terminal.

To attain the above object, in a twelfth aspect of the present invention, there is provided a storage medium storing a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, and a module for generating vibration control information for generating a vibration, based on the performance control information, and for instructing the communication apparatus to transmit the generated vibration control information to the operating terminal.

To attain the above object, in a thirteenth aspect of the present invention, there is provided a storage medium storing a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, and a module for generating vibration control information for generating a vibration, based on the performance control information, and for instructing the communication apparatus to transmit the generated vibration control information to an information apparatus formed in a separate body from the operating terminal.

To attain the above object, in a fourteenth aspect of the present invention, there is provided a storage medium storing a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising a module for generating performance control information for controlling musical tones generated from a tone generating apparatus constituted by the computer, based on the motion information, and outputting the generated performance control information to the tone generating apparatus, a module for storing musical composition data, and a module for generating vibration control information for generating a vibration, based on the musical composition data, and for instructing the communication apparatus to transmit the generated vibration control information to the operating terminal.

According to the present invention, the user can obtain a feeling of operation as well as obtain a feeling of satisfaction as if he or she were aggressively participating in performance or playback of a musical composition or the like, The above and other objects, features, and advantages of the invention will become more apparent from the following detailed description taken in conjunction with the accompanying drawings.

BRIEF DESCRIPTION OF THE DRAWINGS

FIGS. 10A and 10B are views showing operating terminals according to variations of the present invention, in which FIG. 10A is a view showing the appearance of an operating terminal of a ring type, and FIG. 10B is a view showing the appearance of an operating terminal of a glove type.

DETAILED DESCRIPTION OF THE PREFERRED EMBODIMENTS

The present invention will now be described with reference to the drawings showing preferred embodiments thereof.

Figure 1:
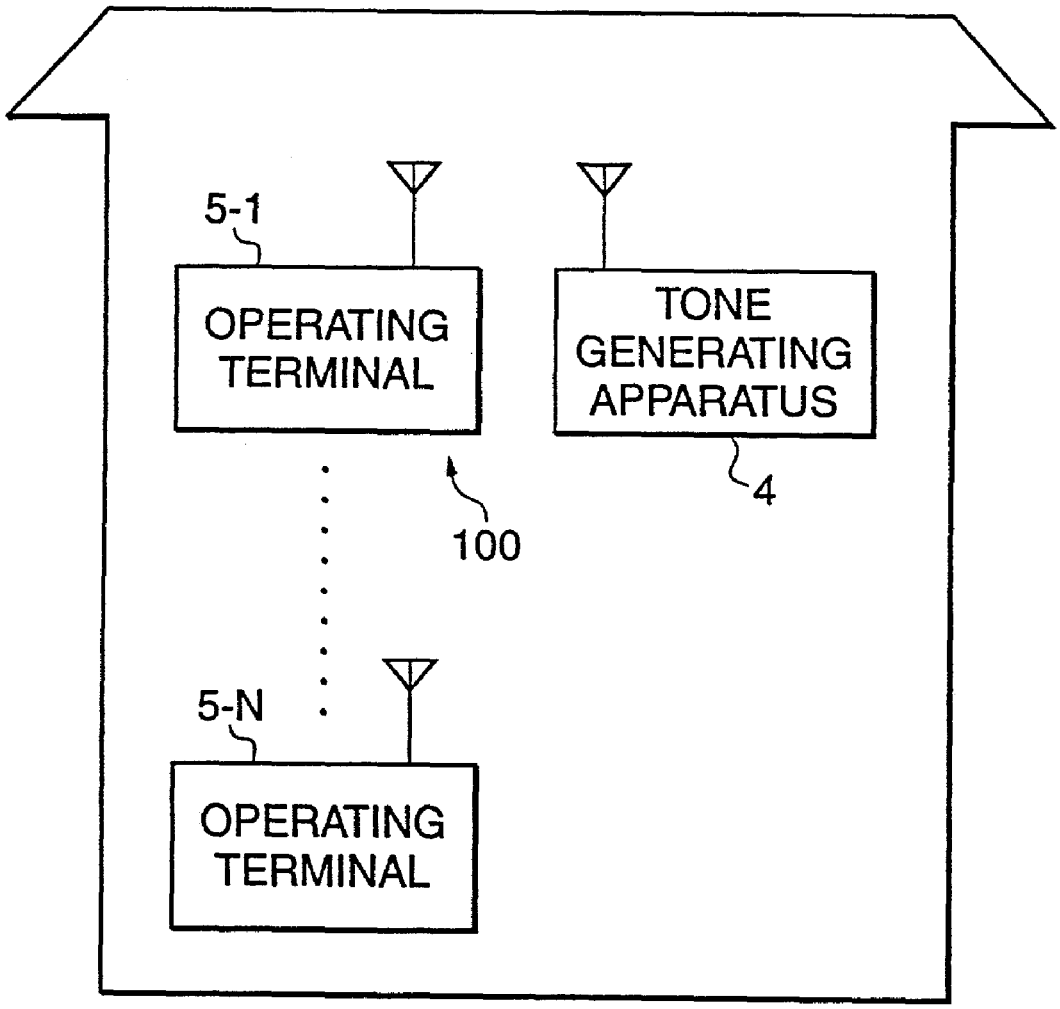
FIG. 1 is a diagram showing the whole construction of a musical tone generation control system according to a first embodiment of the present invention.

FIG. 1 is a diagram showing the whole construction of a musical tone generation control system according to a first embodiment of the present invention.

The musical tone generation control system 100 is intended for use in a music room, a school, a home, a hall or the like and is comprised of a tone generating apparatus 4, and a plurality of operating terminals 5-1 to 5-N for communication with the tone generating apparatus 4.

The tone generation system 100 enables users located at separate places to direct tone generation, and performance or playback (hereinafter referred to as "tone generation or the like") performed by the tone generating apparatus 4. Component elements constituting the musical tone generation control system 100 will be described hereinbelow in detail.

Figure 2:
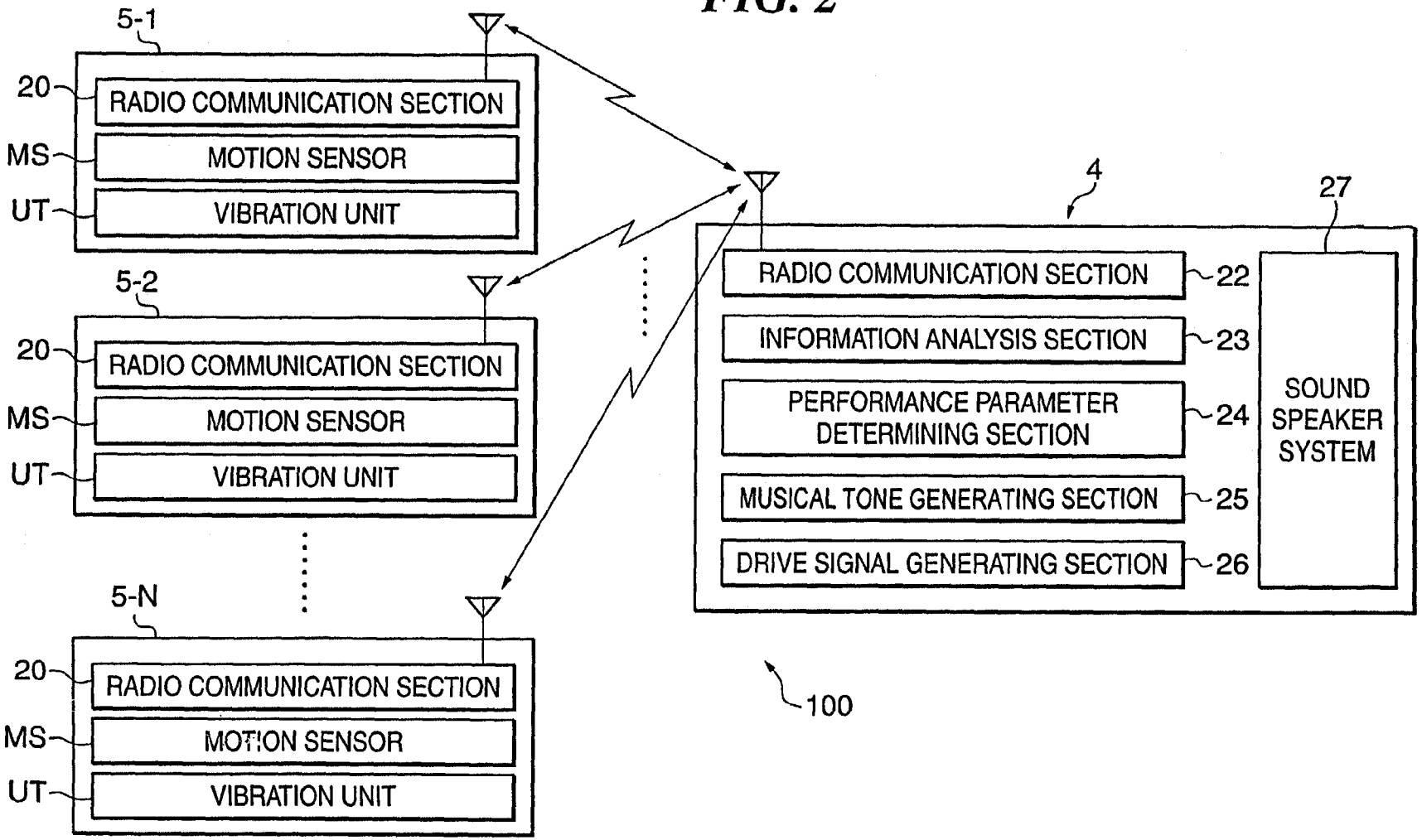
FIG. 2 is a diagram showing the functional construction of the musical tone generation control system 100 of FIG. 1.

FIG. 2 is a diagram showing the functional construction of the musical tone generation control system 100 of FIG. 1. It should be noted that in the following description, where it is not particularly necessary to distinguish between the operating terminals 5-1 to 5-N, these terminals will be collectively referred to as the operating terminal 5.

The operating terminal 5 is adapted to be carried by an operator in such a manner that it is gripped by the operator by hand or mounted on a portion of the operator's body (see FIG. 3), for example.

A motion sensor MS detects a motion based on the motion of the operator's body carrying the operating terminal 5 and generates motion information, and outputs these information to a radio communication section 20. The motion sensor MS may be formed by a three-dimensional acceleration sensor, three-dimensional velocity sensor, two-dimensional acceleration sensor, two-dimensional velocity sensor, strain sensor, or the like, which are all known.

The radio communication section 20 has a role of carrying out data communication by radio communication between itself and the tone generating apparatus 4. When the radio communication section 20 receives motion information corresponding to a motion of the operator from the motion sensor MS, it adds to the motion information an ID for identifying the operating terminal 5 and transmits the motion information to the tone generating apparatus 4 by radio communication, and it receives various information sent from the tone generating apparatus 4 to the operating terminal 5.

A vibration unit UT generates a vibration based on a drive signal, which will be described later, sent from the tone generating apparatus 4 to the operating terminal 5. It should be noted that the mechanism for generating the vibration will be described later.

The tone generating apparatus 4 carries out generation of a drive signal to be supplied to the operating terminals 5 based on the tone generation or the like as well as carries out tone generation based on motion information sent from the respective operating terminals 5. It should be noted that a musical tone generation control apparatus as recited in the appended claims refers to an apparatus comprised of a radio communication section 22, an information analysis section 23, a performance parameter determining section 24, and a drive signal generating section 26, which will be described later, and a tone generating apparatus as recited in the appended claims refers to an apparatus comprised of a musical tone generating section 25 and a sound speaker system 27. In the present embodiment, the tone generating apparatus 4 is comprised of all of the radio communication section 22, the information analysis section 23, the performance parameter determining section 24, the musical tone generating section 25, the drive signal generating section 26 and the sound speaker system 27, which will be described later, by way of example. However, as described above, the musical tone generation control apparatus that carries out generation of a drive signal or the like, and the tone generating apparatus that carries out generation of musical tones or the like may be configured in separate bodies.

The radio communication section 22 receives motion information transmitted through radio communication from the operating terminal 5 and outputs the received motion information to the information analysis section 23.

The information analysis section 23 carries out predetermined analysis processing, described later, on the motion information supplied from the radio communication section 22, and outputs the analysis results to the performance parameter determining section 24.

The performance parameter determining section 24 determines performance parameters such as volume and tempo of musical tones for musical composition data (data according to Musical Instrument Digital Interface; hereinafter referred to as "MIDI data") read from a musical composition data memory (not shown), edits the musical composition data (i.e. MIDI data) based on the determined performance parameters, and outputs the edited data to the musical tone generating section 25 and the drive signal generating section 26.

The musical tone generating section 25, upon receipt of the MIDI data supplied from the performance parameter determining section 24, generates a musical tone signal based on the MIDI data, and outputs the generated musical tone signal to the sound speaker system 27. The sound speaker system 27 carries out tone generation or the like based on the musical tone signal supplied from the musical tone generating section 25.

The drive signal generating section 26, upon receipt of the MIDI data supplied from the performance parameter determining section 24, generates the above-mentioned drive signal based on the MIDI data, and outputs it to the radio communication section 22. The radio communication section 22 transmits the drive signal to the operating terminal 5, whereby a vibration corresponding to the MIDI data is generated by the operating terminal 5.

The musical tone generation control system 100, which is thus equipped with the above-described functions, can achieve faithful tone generation or the like to musical composition data, but also carries out generation of musical tones originally created by the operator, in a manner reflecting the motion of the operator carrying the operation terminal 5. Moreover, the operator carrying the operating terminal 5 can recognize how the motion of himself or herself is reflected on the tone generation or the like by detecting the vibration generated by the operating terminal 5.

Hereinafter, the configurations of the operating terminal 5 and the tone generating apparatus 4 for realizing the above-described functions will be described.

Figure 3:
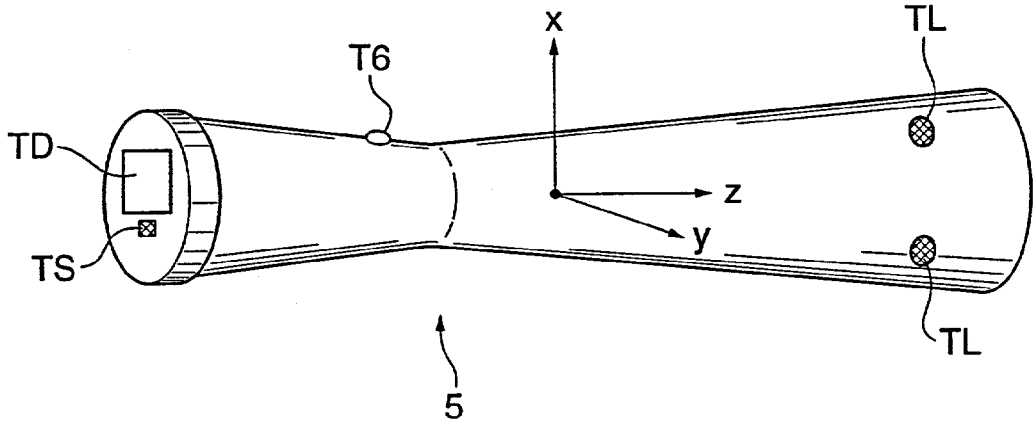
FIG. 3 is a drawing showing the appearance of an operating terminal 5 in FIG. 2.

As shown in FIG. 3, the operating terminal 5 is a so-called hand-held type operating terminal, which is used by the operator gripping in his or her hand. The operating terminal 5 is comprised of a base portion (shown at a left side in FIG. 3) having such a tapered shape that both ends have larger diameters and a central portion has a smaller diameter, and an end portion(shown at a right side in FIG. 3).

The base portion has a smaller mean diameter than that of the end portion such that it can be easily gripped by hand, and it functions as a hand-held portion. An LED (Light Emitting Diode) display device TD and a power source switch TS for a battery source are provided on the outside surface of a bottom portion of the base portion (shown at a left side in FIG. 3), and an operating switch T6 is provided on the outside surface of the central portion. On the other hand, in the vicinity of the tip of the end portion, a plurality of LEDs TL are provided. In the operating terminal 5 having such a configuration, various devices are incorporated.

Figure 4:
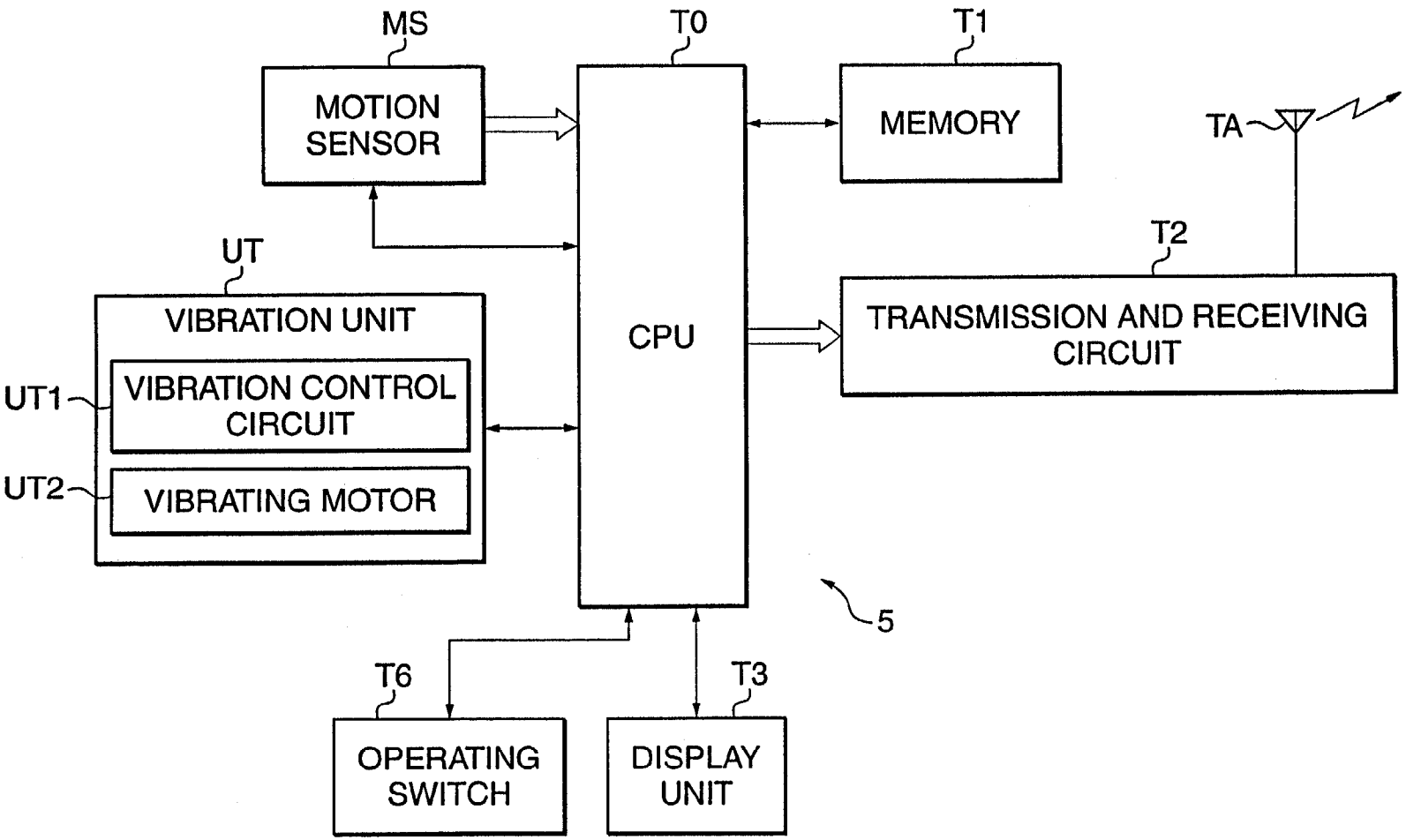
FIG. 4 is a block diagram showing the interior construction of the operating terminal 5 of FIG. 3.

FIG. 4 is a block diagram showing the interior construction of the operating terminal 5 of FIG. 3.

A CPU (Central Processing Unit) T0 controls various sections within the operating terminal 5 such as the motion sensor MS and the vibration unit UT based on various control programs stored in a memory T1 comprised of a ROM, RAM and the like. Moreover, the CPU T0 has a function of adding an ID for identifying the operating terminal 5 to motion information transmitted from the motion sensor MS, a function of supplying a drive signal transmitted through radio communication from the tone generating apparatus 4 to the vibration unit UT, and other functions.

The motion sensor MS is comprised of a three-dimensional acceleration sensor or the like, and outputs motion information corresponding to a direction, magnitude and speed of an operation made by the operator handling the operating terminal 5 by hand. Although in the present embodiment, the motion sensor MS is incorporated in the operating terminal 5, it may be mounted on an optional part of the operator's body.

A transmission and receiving circuit T2 is comprised of a radio frequency transmitter, and an electric power amplifier (neither of which is shown) and others in addition to an antenna TA, and has a function of transmitting motion information, to which the ID supplied from the CPU T0 is added, to the tone generating apparatus 4, and a function of receiving a drive signal transmitted from the tone generating apparatus 4. Specifically, the transmission and receiving circuit T2 realizes the function of the radio communication section 20 shown in FIG. 2.

The vibration unit UT is comprised of a vibration control circuit UT1, a vibrating motor UT2 and others. The vibration control circuit UT1 controls voltage applied to the vibrating motor UT2 based on a drive signal outputted from the radio communication section 20. The vibration control circuit UT1 is provided with a table, not shown, of the relationship between the signal level of the drive signal and the level of voltage to be applied to the vibrating motor UT2. When the vibration control circuit UT1 receives a drive signal from the CPU T0, then it determines the voltage to be supplied to the vibrating motor UT2 by referring to the table. The vibrating motor UT2 is adapted to cause the vibration unit UT to vibrate. The vibration unit UT is constructed such that the intensity, frequency, vibration timing, etc. of the vibration generated in the vibration unit UT can be controlled by controlling the voltage applied to the vibrating motor UT2. Thus, the vibrating motor is controlled by controlling the voltage. However, it is also possible to control that the vibrating motor UT2, for example, by converting the input electric power source to a certain voltage and modulating the pulse width of the output (Pulse Width Modulation).

A display unit T3 is comprised of the above-described LED display device TD, a plurality of LEDs TL and others, and displays various information such as sensor numbers under the control of the CPU T0, and a power source alarm during the operation. The operating switch T6 is used for switching on/off of the power source of the operating terminal 5, setting of various modes, and the like. To these component elements, driving power is supplied from a battery source, not shown. As such a battery source, a primary battery may be used, or a secondary battery which is chargeable may be used.

Figure 5:
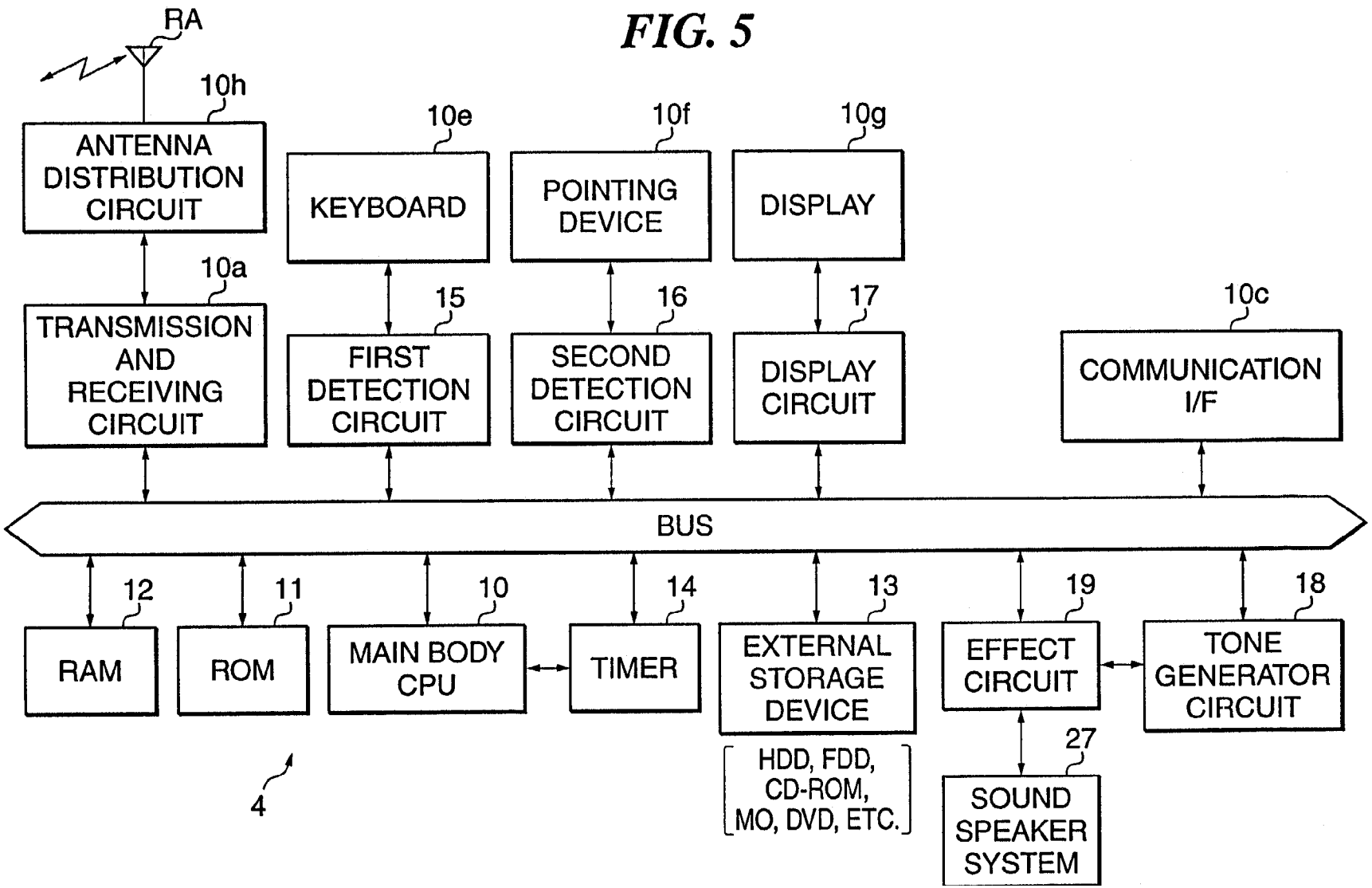
FIG. 5 is a block diagram showing the hardware construction of a tone generating apparatus 4 in FIG. 2.

FIG. 5 is a block diagram showing the hardware configuration of the tone generating apparatus 4 in FIG. 2.

The tone generating apparatus 4 is comprised of a general personal computer (hereinafter, simply referred to as "the PC") in which a radio communication function unit for carrying out radio communication with the operating terminal 5, and the sound speaker system 27 are mounted.

The tone generating apparatus 4 has a main body CPU 10 for controlling various sections of the tone generating apparatus 4, which carries out various kinds of control according to predetermined programs under time control by a timer 14 which is used to generate a tempo clock, an interrupt clock, and the like, mainly for execution of a performance processing program (musical tone generating program) relating to determination of performance parameters, change of musical composition data, and reproduction control. A ROM (Read Only Memory) 11 stores predetermined control programs for controlling the tone generating apparatus 4, including the above-mentioned performance processing (musical tone generating program), and various data/tables and the like. A RAM (Random Access Memory) 12 stores data and parameters required for executing the above programs, and is also used as a work area for temporarily storing various data during the processing.

A key board 10*e* is connected to a first detection circuit 15, a pointing device 10*f* such as a mouse is connected to a second detection circuit 16, and a display 10*g* is connected to a display circuit 17. With this construction, while viewing various screens displayed on the display 10*g*, the user can operate the keyboard 10*e* and the pointing device 10*f*, and carry out various settings and operations such as setting of various modes required for the musical composition data control executed by the tone generating apparatus 4, assignment of processes/functions corresponding to the ID for identifying the operating terminal 5, setting of tone colors (tone generators) for performance tracks, and others.

An antenna distribution circuit 10*h* is connected to a transmission and receiving processing circuit 10*a*. The antenna distribution circuit 10*h* is comprised, for example, of a multi-channel high frequency receiver, and receives motion information from the operating terminal 5 via an antenna RA, and transmits a drive signal generated in the main body CPU 10 to the operating terminal 5 via the antenna RA. The transmission and receiving processing circuit 10*a* carries out predetermined signal processing on signals received from the operating terminal 5 and signals to be transmitted to the operating terminal 5. The transmission and receiving processing circuit 10*a*, the antenna distribution circuit 10*h* and the antenna RA constitute the radio communication section 22 shown in FIG. 2.

The main body CPU 10 carries out performance processing according to the above-described tone generation program, analyzes the motion information representing the motion of the operator's body holding the operating terminal 5, and determines performance parameters based on the analysis results as well as generates a drive signal to be supplied to the operating terminal 5 based on the determined performance parameters. Thus, the main body CPU 10 realizes the functions of the information analysis section 23, the performance parameter determining section 24 and the drive signal generating section 26 shown in FIG. 2. Details of the analysis of the motion information, the determination of the performance parameters, the generation processing of the drive signal and the like will be described later.

An effect circuit 19 is comprised of a DSP (Digital Signal Processor) or the like, and realizes the function of the musical tone generating section 25 shown in FIG. 2 in cooperation with a tone generator circuit 18 and the main body CPU 10. The tone generation circuit 18, the effect circuit 19 or the like generate a musical tone signal based on edited musical composition data (MIDI data) supplied from the main body CPU 10, i.e. based on MIDI data which has been subjected to direction processing according to the motion of the operator and outputs the generated musical tone signal to the sound speaker system 27.

The sound speaker system 27 sounds performance musical tones corresponding to the musical tone signal supplied from the tone generation circuit 18, the effect circuit 19 or the like. It should be noted that the tone generator circuit 18 according to the present embodiment is capable of simultaneously generating musical musical tone signals corresponding to a large number of tracks according to a plurality of systems of sequence programs.

An external storage device 13 is comprised of storage devices such as a hard disc drive (HDD), a compact disc read only memory (CD-ROM) drive, a floppy disc drive (FDD), a magneto-optical (MO) disc drive, and a digital versatile disc (DVD) drive, and can store various data such as various control programs, and musical composition data. Therefore, various programs including the performance processing program (tone generation program) required for determination of performance parameters, change of musical composition data and reproduction control are not only stored in the ROM 11, but also may be stored in the external storage device 13 and read onto the RAM 12 for execution. The external storage device 13 can also store processing results if necessary.

Now, an example of the motion information analysis processing, the performance parameter determination processing and the drive signal generation processing using a three-dimensional acceleration sensor as the motion sensor MS will be described with reference to FIG. 2, FIG. 6 and FIG. 7.

Figure 6:
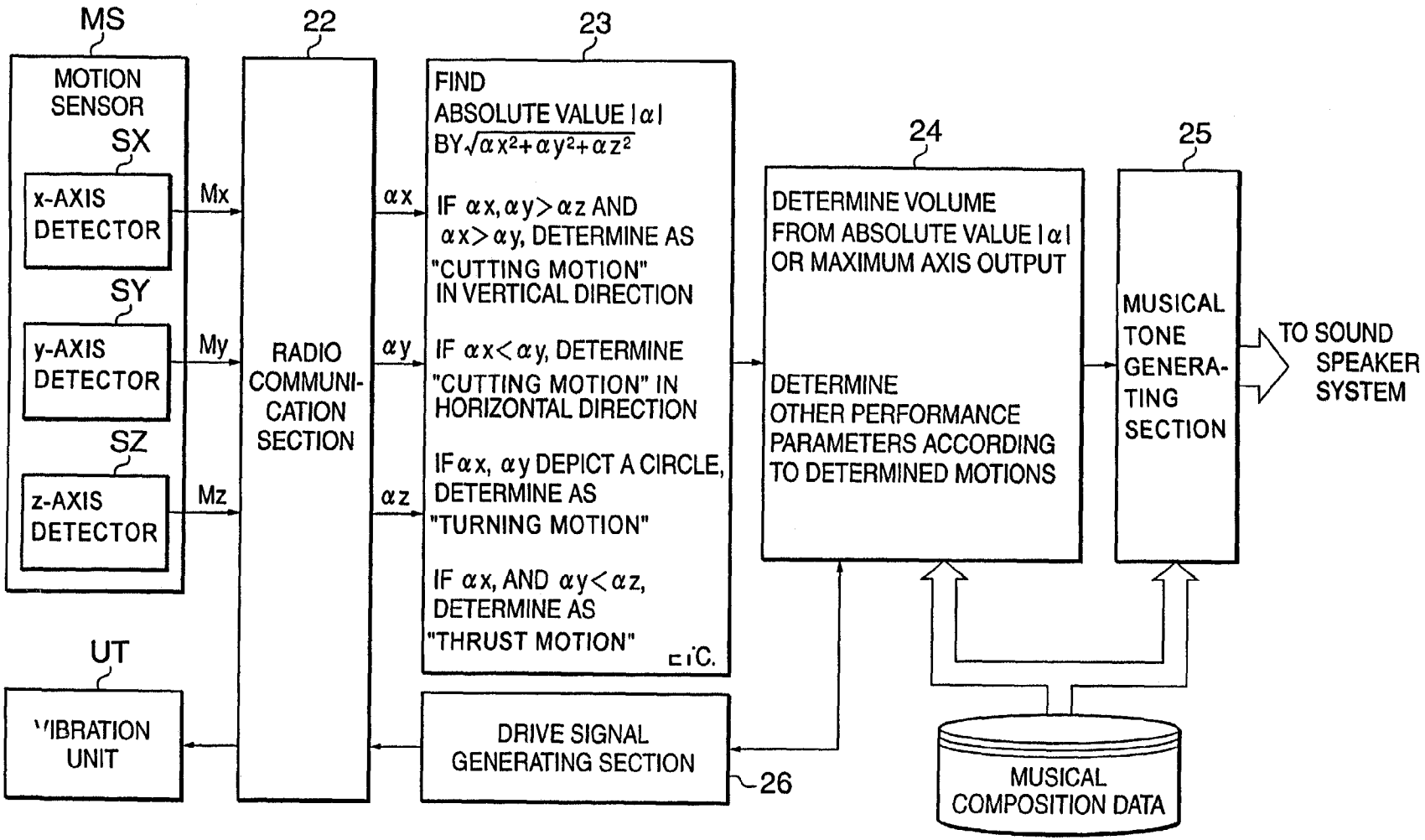
FIG. 6 is a functional block diagram useful in explaining a case where the user directs performance of a musical composition using the musical tone generation control system of FIG. 1.

FIG. 6 is a functional block diagram useful in explaining how the performance of a musical composition is directed by the musical tone generation control system of FIG. 1.

When the operator operates the operating terminal 5 with the motion sensor MS incorporated therein by holding it in hand, motion information corresponding to the direction of the operator's operation and his operating force is transmitted from the operating terminal 5 to the tone generating apparatus 4. More specifically, signals Mx, My and Mz representing the acceleration $\alpha x$ in the x-axis direction, the acceleration $\alpha y$ in the y-axis direction, and the acceleration $\alpha z$ in the z-axis direction are outputted from an x axis detector SX, a y axis detector SY, and a z axis detector SZ of the motion sensor MS in the operating terminal 5, and IDs are added to the respective signals Mx, My and Mz and transmitted to the tone generation device 4 through radio communication as motion information. The radio communication section 22 of the tone generating apparatus 4 refers to a table, not shown, and compares between the IDs added to the received motion information and IDs registered in the table. When the radio communication section 22 confirms from the comparison results that identical IDs with the IDs added to the motion information are registered in the table, it outputs the motion information to the information analysis section 23 as acceleration data $\alpha x$, $\alpha y$ and $\alpha z$.

In the information analysis section 23, first, the acceleration data for each axis is analyzed, and the absolute value $|\alpha|$ of the acceleration represented by the following equation (1) is found:

$$|\alpha|=(\alpha x*\alpha x+\alpha y*\alpha y+\alpha z*\alpha z)^{1/2} \quad (1)$$

Next, the accelerations $\alpha x$, $\alpha y$ and the acceleration $\alpha z$ are compared. If the comparison result shows, for example, that the relationship of an expression (2) shown below holds, that is, the acceleration $\alpha z$ in the z-axis direction is larger than the accelerations $\alpha x$, $\alpha y$ in the x, y-axis directions, it is determined that the operator's motion is a "thrust motion" which thrusts the operating terminal 5 forward.

$$\alpha x>\alpha z, \text{ and } \alpha y<\alpha z \quad (2)$$

Conversely, when the acceleration $\alpha z$ in the z-axis direction is smaller than the accelerations $\alpha x$, $\alpha y$ in the x, y-axis directions, it is determined that the operator's motion is a "cutting motion" which cuts or rips air by the operating terminal 5. In this case, further, by comparing the accelerations $\alpha x$, $\alpha y$ in the x, y-axis directions with each other, it may be determined whether the direction of the "cutting motion" is the "x axis or vertical direction" or the "y axis or horizontal direction".

Moreover, not only the comparison between the respective components in the x, y and z-axis directions, but also the magnitude values of the respective directional components $\alpha x$, $\alpha y$ and $\alpha z$ themselves and respective predetermined threshold values may be compared, and if these values are more than the threshold values, it may be determined that the operator's motion is a "combined motion" which combines the above-mentioned motions. For example, if $\alpha z>\alpha x$, $\alpha z>\alpha y$ and $\alpha x>$"the threshold value of the x component" hold, it is determined that the operator's motion is a thrust/cutting motion that rips air in the "vertical or x-axis direction" and at the same time pushes the operating terminal 5. If $\alpha z<\alpha x$, $\alpha z<\alpha y$, and $\alpha x>$"the threshold value of the x component" and $\alpha y>$"the threshold value of the y component" hold, it is determined that the operator's motion is a "obliquely (in both x, y-axis directions) cutting motion". Furthermore, by detecting a phenomenon that the values of the accelerations $\alpha x$, $\alpha y$ in the x and y-axis directions are changing relative to each other just like depicting a circular trajectory, it can be determined that the operator's motion is a "turning motion" which turns the operating terminal 5 round and round.

The performance parameter determining section 24 determines various performance parameters with respect to the musical composition data (i.e. MIDI data) read from the musical composition data memory, not shown, based on the determination results of the analysis processing by the information analysis section 23. To give an example, the performance parameter determining section 24 controls the volume of musical composition data according to the absolute value $|\alpha|$ of the acceleration or the magnitude of the component indicating the maximum value out of the directional components $\alpha x$, $\alpha y$, $\alpha z$.

Moreover, the performance parameter determining section 24 controls the other parameters based on the determination results as follows: For example, it controls the tempo according to the repetition period of the "cutting motion in the vertical or x-axis direction". Apart from this, if it is determined that the "cutting motion in the vertical direction" is a quick and small motion, then, articulation such as accent is imparted to the reproduced sound, and if it is determined that the "cutting motion in the vertical direction" is a slow and large scaled motion, then, the pitch is lowered. Moreover, if it is determined that the operator's motion is a "cutting motion in the horizontal or y-axis direction", then, a slur effect is imparted, and if it is determined that the operator's motion is a "thrust motion", then, a staccato effect is imparted in the same timing by shortening the tone generation duration, or a single tone is inserted (a tone of a percussion instrument, a shout or the like) into corresponding portions of the musical composition being reproduced, according to the magnitude of the motion. Furthermore, if it is determined that the operator's motion is a "combined motion" of a "cutting motion in the horizontal or y-axis direction" and a "thrust motion", the above-described types of control are applied in combination. If it is determined that the operator's motion is a "turning motion", and its repetition period is long, then, an enhanced reverberation effect is applied according to the repetition period, and if its repetition period is short, then, control is provided so as to generate a trill according to the repetition period. It should be noted that these types of control are only given by way of example, and other than these types of control, for example, the dynamics may be controlled according to local peak values of the accelerations along the respective axes, and the articulation may be controlled according to a peak Q value indicating the sharpness of the local peak.

When the performance parameter determining section 24 completes the determination of performance parameters for the musical composition data and edition of the musical composition data (i.e. MIDI data) based on the determined performance parameters, then it outputs the MIDI data to the drive signal generating section 26 and the musical tone generating section 25.

Figure 7:
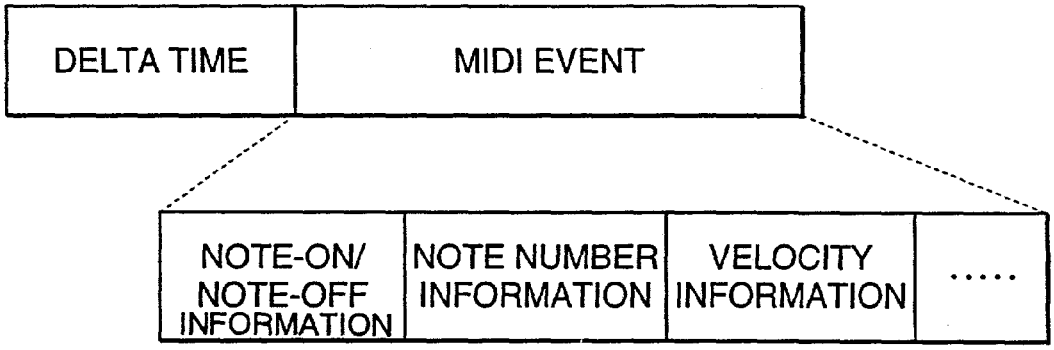
FIG. 7 is a diagram showing the structure of MIDI data outputted from a performance parameter determining section 24.

FIG. 7 is a diagram showing the structure of MIDI data outputted from the performance parameter determining section 24.

The MIDI data is composed of time data which is called "delta time", and data indicating the contents of performance or the like, which is called "MIDI event".

The MIDI event has a general data form including note on/note off information indicating that a musical tone is to be sounded or damped, note number information designating the pitch of a tone (i.e., pitch) to be sounded or damped, and velocity information indicating the intensity of generation of a tone. The MIDI event is composed of, for example, an instruction to "sound a note C (note number) at 10 (velocity)". The delta time is information indicating timing in which the MIDI event is to be executed. When a certain MIDI event is executed, then time t elapsed from the start of the MIDI event is monitored by the main body CPU 10, and when the elapsed time t exceeds the delta time T of the next MIDI event, the next event starts to be executed.

Figure 8:
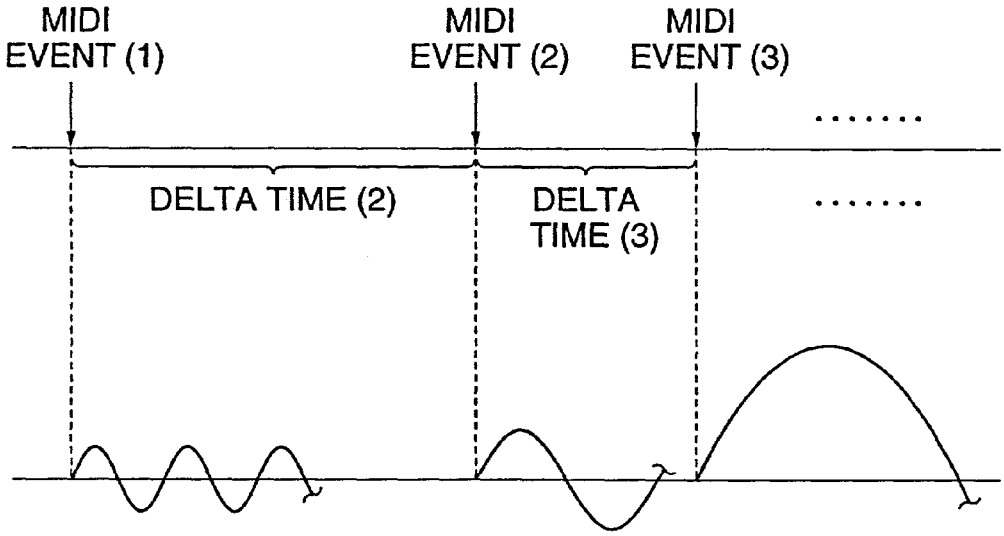
FIG. 8 is a graph useful in explaining a vibration parameter determined by a driving signal generating section 26.

When the drive signal generating section 26 receives MIDI data from the performance parameter determining section 24, then, it generates a drive signal based on the MIDI data. An example of the operation of the section 26 will be given below: The drive signal generating section 26 determines a vibration generation timing based on the delta time constituting the MIDI data, and the intensity of vibration (amplitude) and the type of vibration (frequency) based on the velocity information and note number information constituting the MIDI event. For example, to determine the intensity of vibration, the amplitude level is determined by referring to a table, not shown, which is set such that the amplitude level becomes higher in proportion to an increase in the volume level previously indicated by the velocity information, and to determine the type of vibration, the frequency of vibration is determined by referring to a table, not shown, of the relationship between the pitch previously indicated by the note number information and the frequency (see FIG. 8). Moreover, if a plurality of vibrating motors are used as the vibrating motors UT2, control may be provided such that a vibrating motor to which voltage is to be applied is selected according to the magnitude of the vibration to be generated, and that the magnitude of the voltage to be applied to the respective vibrating motors is changed, for example. Furthermore, control may be provided such that the vibration generation timing is determined based on the performance tempo information and delta time included in the MIDI data. The drive signal generating section 26 generates a drive signal for causing a vibration, based on the vibrating generation timing, the intensity of vibration and the type of vibration thus determined, and outputs it to the radio communication section 22, and the drive signal is supplied to the vibration unit UT via the radio communication section 22.

The musical tone generating section 25 generates a musical tone signal corresponding to MIDI data supplied from the performance parameter determining section 24 and outputs the resulting musical tone performance via the sound speaker system 27. In this way, tone generation or the like is carried out in a manner reflecting the operator's motion, and the operator can recognize how his motion is reflected upon the tone generation or the like by detecting the vibration generated by the operating terminal 5.

FIRST EXAMPLE OF OPERATION

Now, a case where the performance or playback of music is controlled by the operator by operating the operating terminal 5 according to the following conditions will be described.

<Performance parameter determined by the performance parameter determining section 24>

"cutting motion in the vertical or x-axis direction"→performance tempo

<Drive signal generated by the drive signal generating section 25>

A drive signal is generated based on the above-mentioned performance tempo

After the operator turns on the power by operating the operating switch T6 of the operating terminal 5 and the keyboard 10*e* of the tone generating apparatus 4 or the like, when the operator holds the operating terminal such that the operating switch T6 is located upward and swings it in the vertical direction, a signal representing the acceleration $\alpha x$ in the x-axis direction corresponding to the swinging acceleration is generated, and the generated signal is transmitted to the tone generating apparatus 4 as motion information.

When the radio communication section 22 of the tone generating apparatus 4 receives the motion information from the operating terminal 5, it then supplies the motion information to the information analysis section 23 as acceleration data. The information analysis section 23 analyzes the received acceleration data, and when it determines from the results of the analysis, for example, that the operator's motion is a "cutting motion in the vertical or x-axis direction", it outputs repetition period information indicative of the repetition period of the "cutting motion in the vertical or x-axis direction" and the like together with the determination results to the performance parameter determining section 24.

When the performance parameter determining section 24 determines that the operator's motion is a "cutting motion in the vertical or x-axis direction" based on the determination results and the like from the information analysis section 23, it determines the performance tempo based on the repetition period information supplied from the information analysis section 23, and outputs MIDI data including information indicating the determined performance tempo to the drive signal generating section 26 and the musical tone generating section 25. The musical tone generating section 25 generates a musical tone signal based on the MIDI data received from the performance parameter determining section 24 and carries out musical tone performance via the sound speaker system 27.

On the other hand, the drive signal generating section 26 generates a drive signal for generating a vibration at the performance tempo indicated by the received MIDI data, and transmits the generated drive signal to the operating terminal 5 via the radio communication section 22. Upon receipt of the drive signal via the radio communication section 20, the operating terminal 5 transfers the drive signal to the vibration control circuit UT1 within the vibration unit UT. The vibration control circuit UT1 determines voltage to be applied to the vibrating motor UT2 based on the drive signal, and applies the determined voltage to the vibrating motor UT2. In this way, a vibration is generated from the vibration unit UT based on the performance tempo, and the operator can recognize how his motion is reflected upon the tempo of the performance or playback of music.

SECOND EXAMPLE OF OPERATION

In the first example of operation described above, a vibration is generated based on the performance tempo. In the second example of operation, a case where a vibration is generated based on the volume according to the following conditions will be described below.

<Performance parameter determined by the performance parameter determining section 24>

"cutting motion in the horizontal or y-axis direction"—volume

<Drive signal generated by the drive signal generating section 25>

A drive signal is generated based on the above-mentioned volume

After the operator turns on the power by operating the operating switch T6 of the operation terminal 5 and the keyboard 10*e* of the tone generating apparatus 4 or the like, when the operator holds the operating terminal such that t the operating switch T6 is located upward and the operator swings it in the horizontal direction, a signal is generated representing the acceleration $\alpha y$ in the y-axis direction corresponding to the swing acceleration, and the generated signal is transmitted to the tone generating apparatus 4 as motion information.

When the radio communication section 22 of the tone generating apparatus 4 receives the motion information from the operating terminal 5, it supplies the motion information to the information analysis section 23 as acceleration data. The information analysis section 23 analyzes the received acceleration data, and when it determines from the results of the analysis, for example, that the operator's motion is a "cutting motion in the horizontal or y-axis direction", it outputs the repetition period information indicative of the repetition period of the "cutting motion in the horizontal or y-axis direction" and the like together with the determination results to the performance parameter determining section 24.

When the performance parameter determining section 24 determines that the operator's motion is a "cutting motion in the horizontal or y-axis direction", based on the determination results and the like from the information analysis section 23, it determines the volume based on the repetition period information and the like supplied from the information analysis section 23, and outputs MIDI data including information indicating the determined volume (i.e., velocity information) to the drive signal generating section 26 and the musical tone generating section 25. The musical tone generating section 25 generates a musical tone signal based on the MIDI data received from the performance parameter determining section 24 and outputs the resulting musical tone performance via the sound speaker system 27.

On the other hand, the drive signal generating section 26 generates a drive signal for generating a vibration corresponding to the velocity information (volume) indicated by the received MIDI data, and transmits the generated drive signal to the operating terminal 5 via the radio communication section 22. Upon receipt of the drive signal via the radio communication section 20, the operating terminal 5 transfers the drive signal to the vibration control circuit UT1. The vibration control circuit UT1 determines voltage to be applied to the vibrating motor UT2 based on the drive signal, and it applies the determined voltage to the vibrating motor UT2. In this way, a vibration corresponding to the volume of the performance or playback of music is generated by the vibration unit UT, and the operator can recognize how his motion is reflected upon the volume of the performance or playback of music. It should be noted that it is possible to generate a vibration corresponding to the pitch, the timing of tone generation and the like besides the performance tempo, the volume and the like as described above.

As described above, according to the present embodiment, tone generation or the like is carried out in a manner reflecting the operator's motion holding the operating terminal 5 by the tone generating apparatus 4, and the operator can recognize how his motion is reflected upon the performance or playback of music by detecting the vibration generated by the operating terminal 5. Moreover, the operator can obtain a feeling of satisfaction with controlling the performance or playback of music. Moreover, when a person having difficulty in hearing musical tones or the like uses the operating terminal 5, he can recognize what kind of performance, reproduction and the like are performed by the tone generating apparatus 4 by detecting a vibration obtained from the operating terminal 5. Thus, the operating terminal 5 can be utilized as a musical instrument suitable for a person having difficulty in hearing.

Although in the above described embodiment, the operator controls the performance or playback of music by operating the operating terminal 5, the present invention may be applied, for example, to a case where a single tone (a tone of a percussion instrument, a shout or the like) is inserted into the musical tone performance. To generate a single tone corresponding to the operation of the operating terminal 5 by the operator, for example, the vibration may be controlled according to the timing in which the single tone is generated, the magnitude of the tone and the like. As a result, the operator can recognize that the single tone has been generated in what timing and at what degree of magnitude.

Next, a description will be given of a second embodiment of the present invention.

In the above described first embodiment, an example of control of vibration generation by the operating terminal 5 so as to inform the operator of the performance has been given. In the second embodiment, an example of control of the vibration generation by the operating terminal 5 so as to inform the operator of the normal motion will be described.

Figure 9:
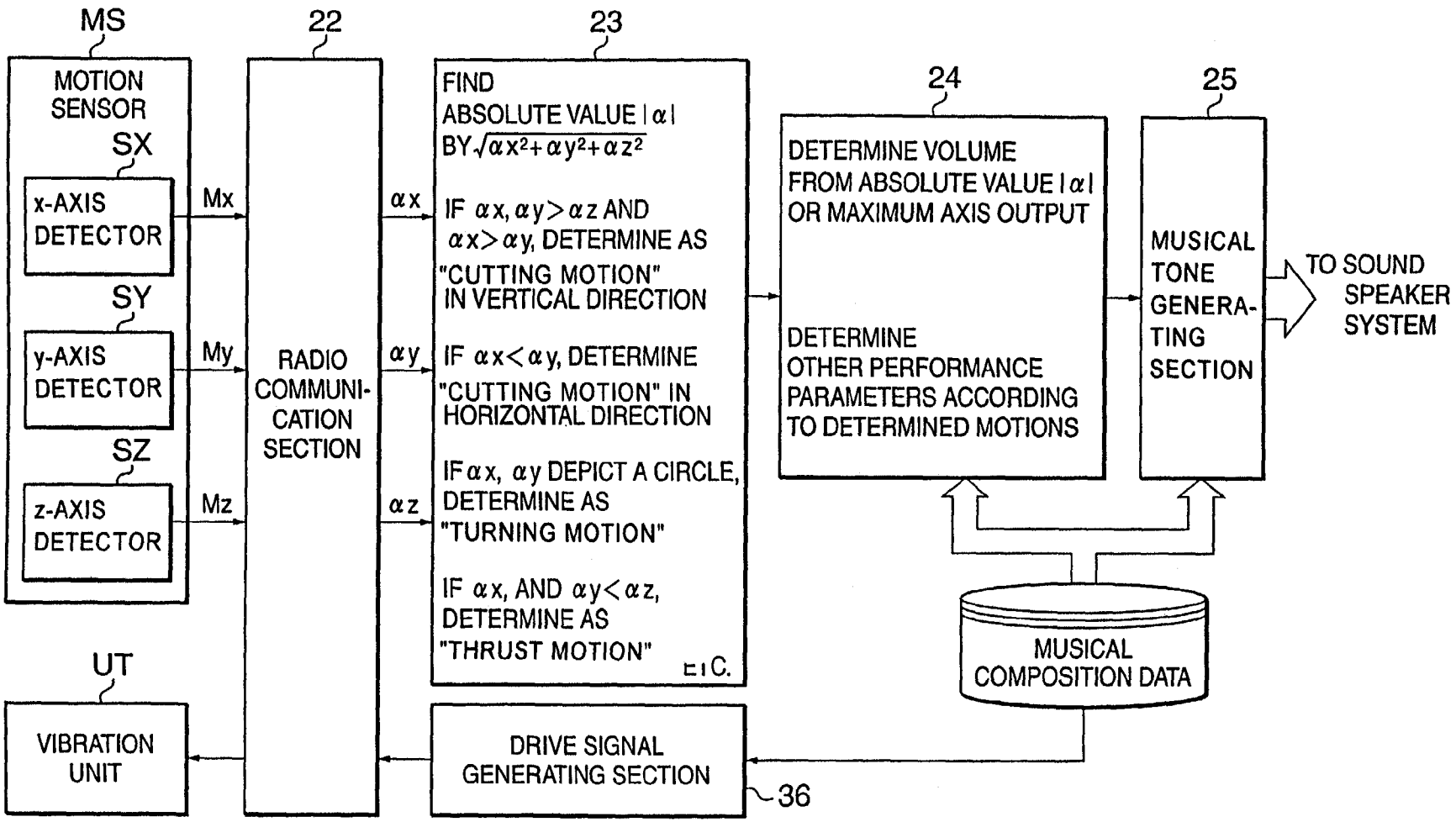
FIG. 9 is a functional block diagram useful in explaining a case where the user directs performance of a musical composition using a musical tone generation control system according to a second embodiment of the present invention.

FIG. 9 is a functional block diagram useful in explaining a case where the user directs performance of a musical composition according to the second embodiment. FIG. 9 is identical in construction to FIG. 6 described above except for the drive signal generating section 36, and therefore elements and parts in FIG. 9 corresponding to those in FIG. 6 are designated by identical reference numerals, and description thereof is omitted.

The performance parameter determining section 24, similarly to the first embodiment described above, determines various performance parameters with respect to musical composition data based on the determination results of the analysis processing by the information analysis section 23, and outputs MIDI data based on the determined performance parameters to the musical tone generating section 25. The musical tone generating section 25 generates a musical tone signal based on the MIDI data received from the performance parameter determining section 24, and outputs the resulting musical tone performance via the sound speaker system 27.

On the other hand, the drive signal generating section 36 reads out, for example, performance tempo information included in the musical composition, generates a drive signal for generating a vibration at the read out performance tempo, and transmits the generated drive signal to the operating terminal 5 via the radio communication section 22. Upon receipt of the drive signal via the radio communication section 20, the operating terminal 5 transfers the drive signal to the vibration unit UT. The vibration control circuit UT1 constituting the vibration unit UT determines voltage to be applied to the vibrating motor UT2 based on the drive signal, and applies the determined voltage to the vibrating motor UT2. Thus, a vibration is generated from the vibration unit UT based on the performance tempo. The operator can grasp a deviation between the timing of generation of the vibration and his motion by detecting the vibration. In this way, the vibration from the operating terminal 5 may be controlled such that information (instruction information) relating to the normal motion control is informed to the operator who operates the operating terminal 5. Although in the present embodiment, the case where a vibration is generated based on normal performance tempo has been given, alternatively the vibration may be generated based on normal volume or the like.

The drive signal generating section 36 according to the second embodiment described above generates a drive signal for generating a vibration at the normal performance tempo, and transmits the generated drive signal to the operating terminal 5 via the radio communication section 22. However, for example, it may be constituted such that normal performance tempo included in the musical composition data read from the musical composition data memory, not shown (hereinafter referred to as "the prescribed performance tempo), and performance tempo included in the edited musical composition data obtained from the performance parameter determining section 24 (hereinafter referred to as "the user performance tempo") are compared with each other, and if, as a result of the comparison, it is determined that a deviation occurs between the two kinds of tempo, a drive signal for generating a vibration is generated, and the generated drive signal is transmitted to the operating terminal 5 via the radio communication section 22. Moreover, a threshold value may be provided in advance for comparing the two kinds of tempo, and a deviation between the prescribed performance tempo and the user performance tempo is obtained by comparing the prescribed performance tempo and the user performance tempo with each other, and only when the deviation exceeds the threshold value, a drive signal for generating a vibration may be generated. Furthermore, it may be constituted such that the intensity of the vibration is determined according to the time period for which not less than a predetermined amount of deviation is detected between the performance tempos. It should be noted that these operating terminals 5 may be used not only simply for generating musical tones or the like but also may be used as instruments for rehabilitation, for example, for patients having chronic diseases and patients suffering from aftereffects.

Figure 10A:
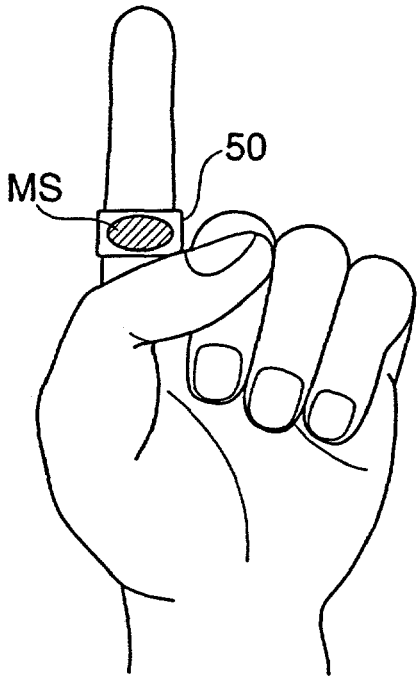
Figure 10B:
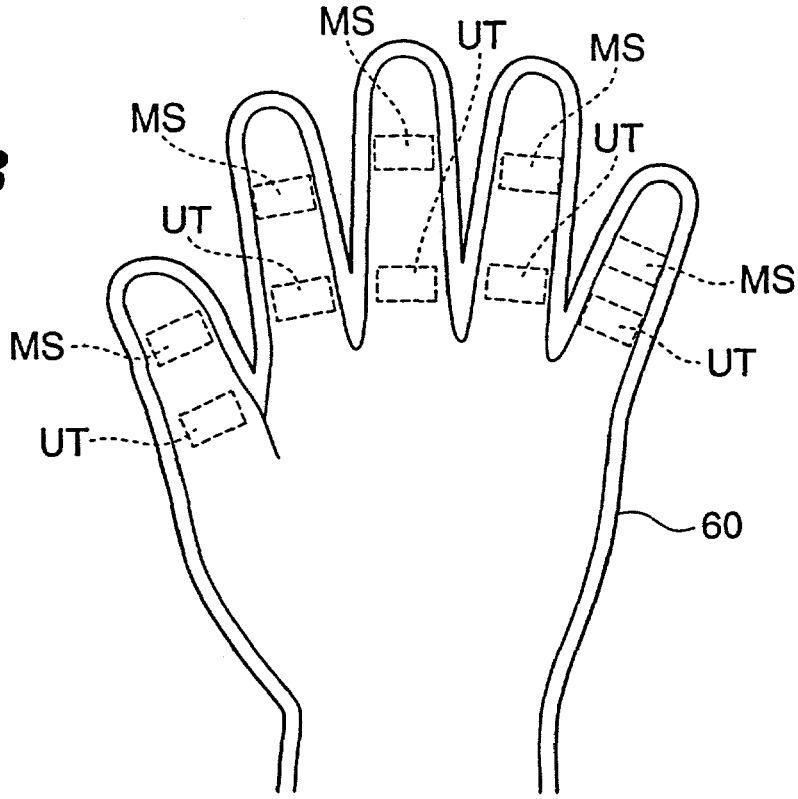

Moreover, although in the first and second embodiments described above, the so-called hand-held type operating terminal 5 that the operator uses while he or she holds in his or her hand is employed, alternatively the present invention may be applied to a ring-type operating terminal 50 as shown in FIG. 10A, and a glove type operating terminal 60 as shown in FIG. 10B. In the case where the present invention is applied to the glove type operating terminal 60, it is possible to provide the motion sensor MS described above for each finger, and furthermore, it is also possible to provide the vibration unit UT for each finger. In the case where a plurality of the vibration units UT are provided, for example, the correspondence between channel numbers included in the MIDI event and the respective vibration units UT is prepared. With this correspondence, for example, when the operator who wears the glove type operating terminal 60 on his or her hand carries out such an operation of bending his or her index finger, MIDI data for a channel number "1" is generated according to the operation, and MIDI data for channel numbers from "1" to "5" corresponding to the respective fingers are generated according to such vibration control that the index finger is vibrated or such an operation that the hand is waved. Thus, such vibration control that all of the fingers of the hand on which the operating terminal 60 is worn are vibrated can be carried out.

Although in the first and second embodiments described above, the case where the vibration unit UT is incorporated in the operating terminal 5 is exemplified, alternatively, the operating terminal 5 and a separate vibration unit UT may be connected to each other, for example, by a wire method using a RS232C or the like or by a radio communication method using Bluetooth or the like, and a vibration may be generated at a location different from the hand holding the operating terminal 5 (e.g., the vibration unit placed on the operator's shoulder).

Figure 11:
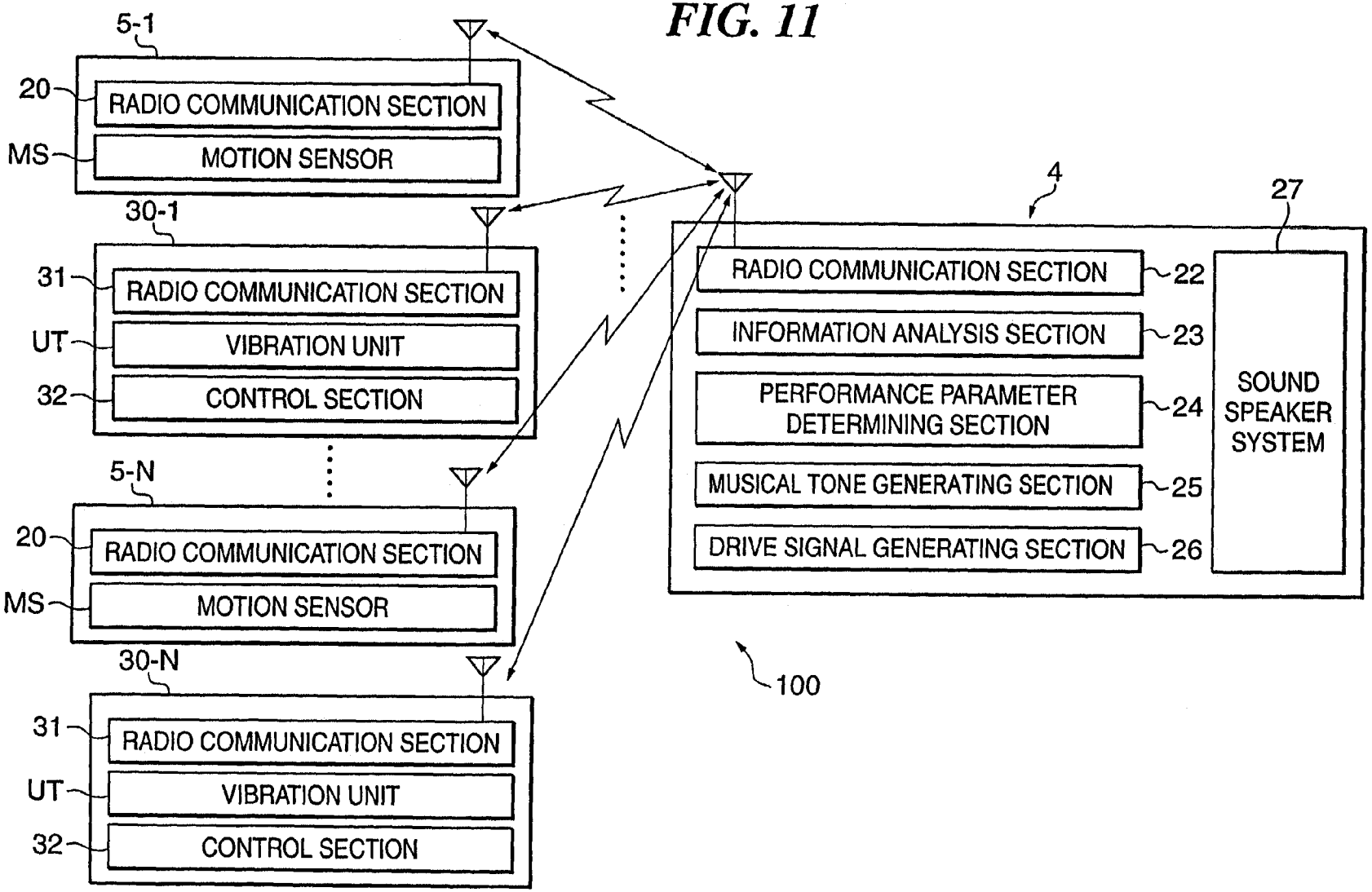
FIG. 11 is a diagram showing the functional construction of a musical tone generation control system according to a variation of the present invention.

Moreover, as shown in FIG. 11, there may be provided informing apparatuses 30-1 to 30-N (hereinafter simply referred to as the informing apparatuses 30) each comprised of a radio communication section 31 that transmits an ID for identifying the informing apparatus and receives a drive signal from the tone generating apparatus 4, a vibration unit UT that generates a vibration based on the drive signal, and a control section 32 that controls various sections of the informing apparatus. Further, a table of the relationship between IDs for identifying the informing apparatuses 30 and IDs for identifying operating terminals 5-1 to 5-N may be stored in the RAM 12 of the tone generating apparatus 4. In this way, it is possible to construct a musical tone generation control system comprised of the operating terminals 5-1 to 5-N, the informing apparatuses 30, and the tone generating apparatus 4. Although in the first and second embodiments described above, a single operator uses the operating terminals 5-1 to 5N, it is also possible for a plurality of operators to use a plurality of operating terminals 5. Moreover, in the first and second embodiments described above, the present invention is applied to the case where the operating terminal 5 and the tone generating apparatus 4 are connected through radio communication. However, the present invention may be applied to a construction that the operating terminal 5 and the tone generating apparatus 4 are connected by a wire method using a RS232C or the like.

Moreover, the operating terminals 5, 50 and 60 (hereinafter simply referred to as "the operating terminal 5") according to the embodiments and the variations described above are configured to be equipped with the motion sensor MS, the radio communication section 20 and the vibration unit UT. However, in addition to these components, the operating terminal 5 may be configured to be equipped with the information analysis section 23, the performance parameter determining section 24 and the drive signal generating section 26, which are provided in the tone generating apparatus 4 in the embodiments and the variations. If the operating terminal 5 has the functions of these components, the tone generating apparatus 4 is comprised of only the radio communication section 22, the musical tone generating section 25, and the sound speaker system 27. With this construction, when the tone generating apparatus 4 receives musical composition data (e.g., data according to the MIDI Standards) based on the performance parameters determined by the performance parameter determining section 24 from the operating terminal 5, it generates a musical tone signal based on the MIDI data and carries out tone generation or the like by outputting the generated musical tone signal to the sound speaker system 27. It should be noted that the above described variation is merely an example, and any or all of the component elements (e.g., the musical tone generating section 25, and the sound speaker system 27) provided in the tone generating apparatus 4 described above may be provided in the operating terminal 5 according to a desired design of the operating terminal 5.

Furthermore, the operating terminal 5 that controls performance tempo, volume and other parameters of a musical composition according to any of the above described embodiments, and the operating terminal 5 that controls timing of generation of a handclap, a shout or the like may be used in combination, and then a musical educational service or an entertainment service may be provided.

As the musical educational service, an instructor uses the operating terminal 5 that controls the performance tempo, volume, etc. of a principal performance part of a musical composition, and trainees use the other operating terminal 5 that controls timing of generation of a handclap, a shout or the like and other operating terminals 5 which are set to play accompaniment parts. When the instructor controls the performance tempo and volume of the musical composition by operating the operating terminal 5, vibrations are generated according to the reproduction tempo of the principal performance part by the other operating terminals 5 of the respective trainees. Then, the trainees can detect the respective vibrations and insert a shout, handclap, percussion tone, etc. in predetermined timing, or the trainees can control the performance of the accompanying parts along with the reproduction of the principal performance part according to the motion of the instructor. In this way, it is also possible to generate vibrations by the operating terminals for the trainees, which are different from the operating terminal for the instructor, which detects the motion of the instructor.

As the entertainment service, the principal performer such as a musician uses the operating terminal 5 for the principal performer, which is set to control the principal performance part of the musical composition, and the participants uses the operating terminals 5 for participants, which are set to control timing of generation of a handclap, a shout or the like and the operating terminals for the other participants, which are set to play accompaniment parts. When the principal performer controls the performance tempo and volume of the principal performance part of the musical composition by operating the operating terminal 5 for the principal performer, vibrations are generated according to this performance tempo and volume by the operating terminals 5 for the respective participants. The participants can detect the respective vibrations and insert a shout, handclap, percussion tone, etc. in predetermined timing, and can control the performance of the accompaniment parts along with the principal performance or reproduction according to the motion of the principal performer.

It goes without saying that the objects of the present invention can also be achieved by supplying a system or an apparatus with a storage medium storing program code of a software program that realizes the functions of the embodiments described above, and then causing a computer (or CPU, MPU or the like) of the system or apparatus to read and execute the program code stored on the storage medium. More specifically, the software program may be installed into a personal computer or the like from the storage medium storing the software, or the software program may be downloaded from a server provided with the software via a network (e.g., the Internet) and installed into the personal computer or the like In this case, the program code itself read from the storage medium realizes the functions of the embodiments described above, and hence the storage medium on which the program code is stored constitutes the present invention. Examples of the storage medium for supplying the program code include a floppy disk, a hard disk, an optical disk, a magnetic-optical disk, a CD-ROM, a CD-R, a magnetic tape, a nonvolatile memory card, and a ROM. Alternatively, the program code may be downloaded from a network.

Moreover, it also goes without saying that the functions of the embodiments described above may be realized not necessarily by causing the computer to read and execute the program code, but alternatively by causing an operating system (OS) running on the computer to perform part or all of the actual processing based on instructions in the program code.

Furthermore, it also goes without saying that the functions of the embodiments described above may be realized by writing the program code read from the storage medium into a memory provided on a function expansion board inserted into the computer or in a function expansion unit connected to the computer, and then causing a CPU or the like provided on the function expansion board or in the function expansion unit to perform part or all of the actual processing based on instructions in the program code.

Moreover, in the above described embodiments and variations, the operating terminal 5 and the tone generating apparatus 4 are formed in separate bodies. However, for example, a hardware source for realizing the functions of the tone generating apparatus 4 may be incorporated in the operating terminal 5, and software for realizing the functions may be installed in the operating terminal 5.

The above described embodiments are merely illustrative of the present invention, and the present invention is not limited to them, but may be arbitrarily modified within the scope of the appended claims.

What is claimed is:

1. A musical tone generation control system comprising:

at least one operating terminal that can be carried by an operator; and a musical tone generation control apparatus including a tone generating apparatus that generates musical tones;

said operating terminal having a device that detects a motion of the operating terminal caused by an operation of the operator, generates motion information based on the detected motion, and transmits the generated motion information to said musical tone generation control apparatus;

said musical tone generation control apparatus having a device that generates performance control information for controlling musical tones generated from said tone generating apparatus based on the received motion information, generates vibration control information based on the generated performance control information, and transmits the generated vibration control information to said operating terminal; and said operating terminal having a device that generates a vibration corresponding to the received vibration control information wherein said vibration exhibits a vibration characteristic selected from the group consisting of vibration generation timing, vibration frequency, and intensity of vibration.

2. A musical tone generation control system according to claim 1, wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

3. A musical tone generation control system according to claim 1, further comprising:

a storage device that stores musical composition data.

4. A musical tone generation control system according to claim 3, wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

5. A musical tone generation control system comprising:

at least one operating terminal that can be carried by an operator;

at least one informing apparatus formed in a separate body from said operating terminal; and a musical tone generation control apparatus including a tone generating apparatus that generates musical tones;

said operating terminal having a device that detects a motion of said operating terminal caused by an operation of the operator, generates motion information based on the detected motion, and transmits the generated motion information to said musical tone generation control apparatus;

said musical tone generation control apparatus having a device that generates performance control information for controlling musical tones generated from said tone generating apparatus based on the received motion information, generates control information based on the generated performance control information, and transmits the generated control information to said informing apparatus; and said informing apparatus having a device that generates an informing signal corresponding to the received control information wherein said informing signal exhibits a variable characteristic selected from the group consisting of signal generation timing, frequency, and intensity.

6. A musical tone generation control system according to claim 5, wherein the performance control information is for controlling at least one parameter selected from the group consisting of tempo, volume, pitch, tone generation timing, tone color, and effect, and said control information is for controlling at least one parameter selected from the group consisting of vibration generation timing, vibration frequency, and intensity of vibration.

7. The musical tone generation control system of claim 5 wherein said control information based on the generated performance control information constitutes vibration control information and wherein said informing signal constitutes vibration of said informing apparatus.

8. The musical tone generation control system of claim 5 wherein said operating terminal is a first handheld device and wherein said at least one informing apparatus is a second handheld device.

9. A musical tone generation control method comprising the steps of:

detecting a motion of at least one operating terminal that can be carried by an operator, caused by an operation of the operator, generating motion information based on the detected motion, and transmitting the generated motion information to a musical tone generation control apparatus including a tone generating apparatus that generates musical tones;

generating performance control information for controlling musical tones generated from said tone generating apparatus based on the received motion information, generating vibration control information based on the generated performance control information, and transmitting the generated vibration control information to said operating terminal; and causing said operating terminal to generate a vibration corresponding to the received vibration control information, wherein said vibration exhibits a vibration characteristic selected from the group consisting of vibration generation timing, vibration frequency, and intensity of vibration.

10. A musical tone generation control method according to claim 9, wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

11. A musical tone generation control apparatus comprising:

a tone generating apparatus that generates musical tones;

a device that receives motion information from at least one operating terminal that can be carried by an operator, the motion information being generated by said operating terminal by detecting a motion of the operating terminal caused by an operation of the operator; and a device that generates performance control information for controlling musical tones generated from said tone generating apparatus based on the received motion information, and generates vibration control information based on the generated performance control information, and transmits the generated vibration control information to the operating terminal, wherein said vibration exhibits a vibration characteristic selected from the group consisting of vibration generation timing, vibration frequency, and intensity of vibration.

12. A musical tone generation control apparatus according to claim 11, wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

13. A musical tone generation control apparatus according to claim 11 further comprising:

a storage device that stores musical composition data.

14. A musical tone generation control apparatus according to claim 13, wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

15. A musical tone generation control apparatus comprising:

a tone generating apparatus that generates musical tones;

a device that receives motion information from at least one operating terminal that can be carried by an operator, the motion information being generated by said operating terminal by detecting a motion of the operating terminal caused by an operation of the operator; and a device that generates performance control information for controlling musical tones generated from said tone generating apparatus based on the received motion information, and generates vibration control information based on the generated performance control information, and transmits the generated vibration control information to at least one information apparatus formed in a separate body from the operating terminal wherein the information apparatus generates a vibration signal based on the transmitted vibration control information;

wherein the performance control information is for controlling at least one parameter selected from the group consisting of tempo, volume, pitch, tone generation timing, tone color, and effect, and said vibration control information is for controlling at least one parameter selected from the group consisting of vibration generation timing, vibration frequency, and intensity of vibration.

16. A storage medium storing a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising:

a module for generating performance control information for controlling musical tones generated from a tone generating apparatus constituted by the computer, based on the motion information, and outputting the generated performance control information to the tone generating apparatus; and a module for generating vibration control information for generating a vibration, based on the performance control information, and for instructing the communication apparatus to transmit the generated vibration control information to the operating terminal.

17. A storage medium according to claim 16, wherein the program further comprises:

a module for storing musical composition data.

18. A storage medium storing a musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising:

a module for generating performance control information for controlling musical tones generated from a tone generating apparatus constituted by the computer, based on the motion information, and outputting the generated performance control information to the tone informing apparatus; and a module for generating control information for generating a vibration, based on the performance control information, and for instructing the communication apparatus to transmit the generated control information to an information apparatus formed in a separate body from the operating terminal.

19. A musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising:

a module for generating performance control information for controlling musical tones generated from a tone generating apparatus constituted by the computer, based on the motion information, and outputting the generated performance control information to the tone generating apparatus; and a module for generating vibration control information for generating a vibration, based on the performance control information, and for instructing the communication apparatus to transmit the generated vibration control information to the operating terminal;

further comprising a computer-readable storage medium that stores at least one of said modules; and a module for storing musical composition data.

20. A musical tone generation control program executable by a computer connected to a communication apparatus, for receiving, via the communication apparatus, motion information from at least one operating terminal that can be carried by an operator, the motion information being generated by detecting a motion of the operating terminal caused by an operation of the operator, the program comprising:

a module for generating performance control information for controlling musical tones generated from a tone generating apparatus constituted by the computer, based on the motion information, and outputting the generated performance control information to the tone generating apparatus; and a module for generating vibration control information for generating a vibration, based on the performance control information, and for instructing the communication apparatus to transmit the generated vibration control information to the operating terminal;

further comprising a computer-readable storage medium that stores at least one of said modules; and a module for storing musical composition data, wherein at least one of said modules is configured for delivery to said computer from a network.

21. The musical tone generation control program according to claim 20 wherein said network includes the Internet.

22. A musical tone generation control apparatus comprising:

a tone generating apparatus that generates musical tones;

a device that receives motion information from at least one operating terminal that can be carried by an operator, the motion information being generated by said operating terminal by detecting a motion of the operating terminal caused by an operation of the operator; and a device that generates performance control information for controlling musical tones generated from said tone generating apparatus based on the received motion information, and generates control information based on the generated performance control information, and transmits the generated control information to at least one information apparatus formed in a separate body from the operating terminal;

wherein said information apparatus is configured to provide an information signal to the user, and wherein the performance control information is for controlling at least one parameter selected from the group consisting of tempo, volume, pitch, tone generation timing, tone color, and effect, and said control information is for controlling at least one parameter associated with said information signal selected from the group consisting of vibration generation timing, vibration frequency, and intensity of vibration.

* * * * *